United States Patent [19]

Yoshieda

[11] Patent Number: 4,765,524

[45] Date of Patent: Aug. 23, 1988

[54] GARMENT-FASTENER ASSEMBLING APPARATUS WITH RAM-DRIVEN POSITION INDICATOR

[75] Inventor: Keiichi Yoshieda, Kurobe, Japan

[73] Assignee: Yoshida Kogyo K.K., Tokyo, Japan

[21] Appl. No.: 88,266

[22] Filed: Aug. 24, 1987

[30] Foreign Application Priority Data

Aug. 26, 1986 [JP] Japan ..... 61-129900[U]

[51] Int. Cl.[4] ..... A41H 37/10

[52] U.S. Cl. ..... 227/18; 227/43; 227/115; 227/116; 227/119; 227/156; 29/720

[58] Field of Search ..... 29/720, 721; 227/18, 227/110, 115, 116, 117, 119, 149, 156

[56] References Cited

U.S. PATENT DOCUMENTS 3,964,661 6/1976 Schmidt et al. ..... 227/18

4,605,150 8/1986 Ikehara ..... 227/18

FOREIGN PATENT DOCUMENTS 60-113329 7/1985 Japan .

*Primary Examiner*—Timothy V. Eley

*Attorney, Agent, or Firm*—Hill, Van Santen, Steadman & Simpson

[57] ABSTRACT

A garment-fastener assembling apparatus includes a drive mechanism for reciprocating an optical position indicator toward and away from an indicating position located in registry with the path of movement of a punch. The drive mechanism is constructed to operate under direct control of the movement of the ram so that the position indicator is reciprocated without interference with the punch or any other movable part of the apparatus and without causing prolongation of the cycle time of the apparatus.

6 Claims, 5 Drawing Sheets

GARMENT-FASTENER ASSEMBLING APPARATUS WITH RAM-DRIVEN POSITION INDICATOR

BACKGROUND OF THE INVENTION

1. Field of the Invention

The present invention relates gnerally to an apparatus for assembling a pair of fastener elements of a garment fastener, such as a button, a snap button, a rivet or an ornament, with a garment fabric disposed between the two fastener elements. More particularly, it relates to a fastener-assembling apparatus having an improved drive mechanism for reciprocating an optical position indicator for indicating a position on the garment fabric where the two fastener elements are to be attached.

2. Prior Art

There have been proposed various fastener-assembling apparatus of the type including a pair of upper and lower holder units for holding respectively thereon a pair of fastener elements, a punch vertically reciprocable toward and away from a die to clinch the two fastener elements with a garment fabric disposed therebetween, and an optical position indicator for indicating a position on the garment fabric where the two fastener elements are to be attached.

The position indicator is driven by a drive mechanism which is structurally and functionally independent from a punch-driving mechanism. The indicator-driving mechanism is so constructed as to reciprocate the position indicator between an advanced indicating position and a retracted standby position in such a manner that an advancing motion of the position indicator begins subsequent to arrival of the punch at its uppermost standby position, and a retracting motion of the position indicator begins prior to departure of the punch from the uppermost standby position.

With this timed operational relation between the punch and the position indicator, it is difficult to operate the fastener-assembling apparatus at a high speed. Furthermore, the position indicator is likely to interfere with the upper holder unit while the upper unit is reciprocating in unison with the punch. Accordingly, a tedious and time-consuming adjustment is necessary to accurately time the reciprocation of the position indicator with the vertical reciprocation of the punch.

SUMMARY OF THE INVENTION

It is therefore an object of the present invention to provide a fastener-assembling apparatus having a drive mechanism capable of reciprocating an optical position indicator without interference with any other movable part of the apparatus and without causing prolongation of the cycle time of the apparatus.

According to the present invention, the foregoing and other objects of the present invention are attained by a garment-fastener assembling apparatus including a drive mechanism operative under the control of the movmement of a punch-driving ram for reciprocating an position indicator toward and away from an indicating position located in registry with the path of movement of a punch. The drive mechanism includes a driver slidably mounted on a stationary guide block and horizontally reciprocable in response to vertical movement of the ram, a pivot lever pivotably supported by a frame and angularly reciprocable in response to horizontal movement of the driver, a slide bar slidably mounted on the guide block and supporting the optical position indicator, the slide bar being pivotably connected with the pivot lever to reciprocate the optical position indicator toward and away from the indicating position in response to angular movement of the pivot lever, and biasing means for urging the slide bar in a direction to move the optical position indicator toward the indicating position.

Many other advantages and features of the present invention will become manifest to those versed in the art upon making reference to the detailed description and the accompanying sheets of drawings in which a preferred structural embodiment is incorporating the principles of the present invention are shown by way of illustrative example.

DETAILED DESCRIPTION

Figure 1:
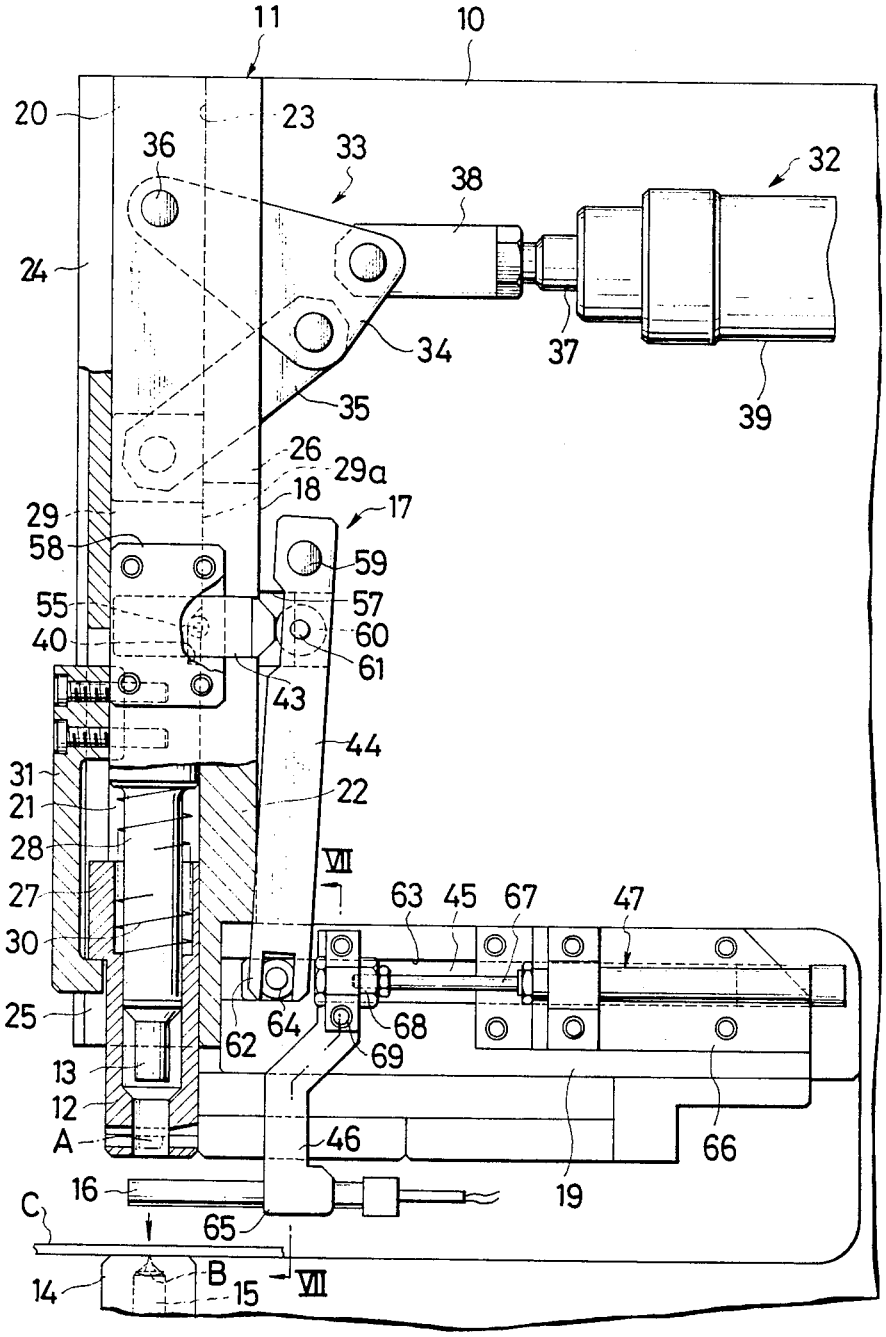
FIG. 1 is a fragmentary front elevational view, partly in cross section, of a fastener assembling apparatus embodying the present invention, the apparatus incorporating a drive mechanism for reciprocating an optical position indicator.

FIG. 1 shows a working station of a fastener-assembling apparatus at which a pair of fastener elements A, B are assembled together, with a garment fabric C disposed between the two fastener elements. The fastener-assembling apparatus includes a generally C-shaped frame 10 vertically mounted on a table (not shown), a generally L-shaped guide block 11 secured to the frame 10, a tubular upper holder 12 vertically slidably mounted on the guide block 11 for holding one fastener element A, a punch 13 vertically reciprocable within the tubular holder 12, a lower holder 14 supported by the frame 10 for holding the other fastener element 13, a die 15 vertically reciprocable within the lower holder 14, and an optical position indicator 16 for indicating a position on the garment fabric C where the two fastener elements A, B are to be attached. The optical position indicator 16 is driven by a drive mechanism 17 to reciprocate between an advanced indicating position of FIG. 1 in which a light projector (not shown) of the position indicator 16 is in registry with the path of movement of the punch 13, and a retracted standby position of FIG. 8 in which the position indicator 16 is located remote from the path of movement of the punch 13.

The L-shaped guide block 11 includes a vertical ram guide 18 and a horizontal elongate base 19 extending perpendicularly from a lower end of the vertical ram guide 18. The ram guide 18 has a tunnel shape, as clearly shown in FIG. 4, and includes a pair of parallel spaced front and rear walls 20, 21 joined along their one longitudinal edges by a side wall 22 so as to define therebetween a vertical guide channel 23. An elongate cover plate 24 is secured to the front and rear walls 20, 21 to close the guide channel 23 from a direction opposite to the side wall 22. The cover plate 24 has a vertical slot 25 extending longitudinally from the lower end to an intermediate portion of the cover plate 24. The ram guide 18 has a vertical groove 26 extending in and along an upper portion of the side wall 22 and communicating with the guide channel 23.

Figure 8:
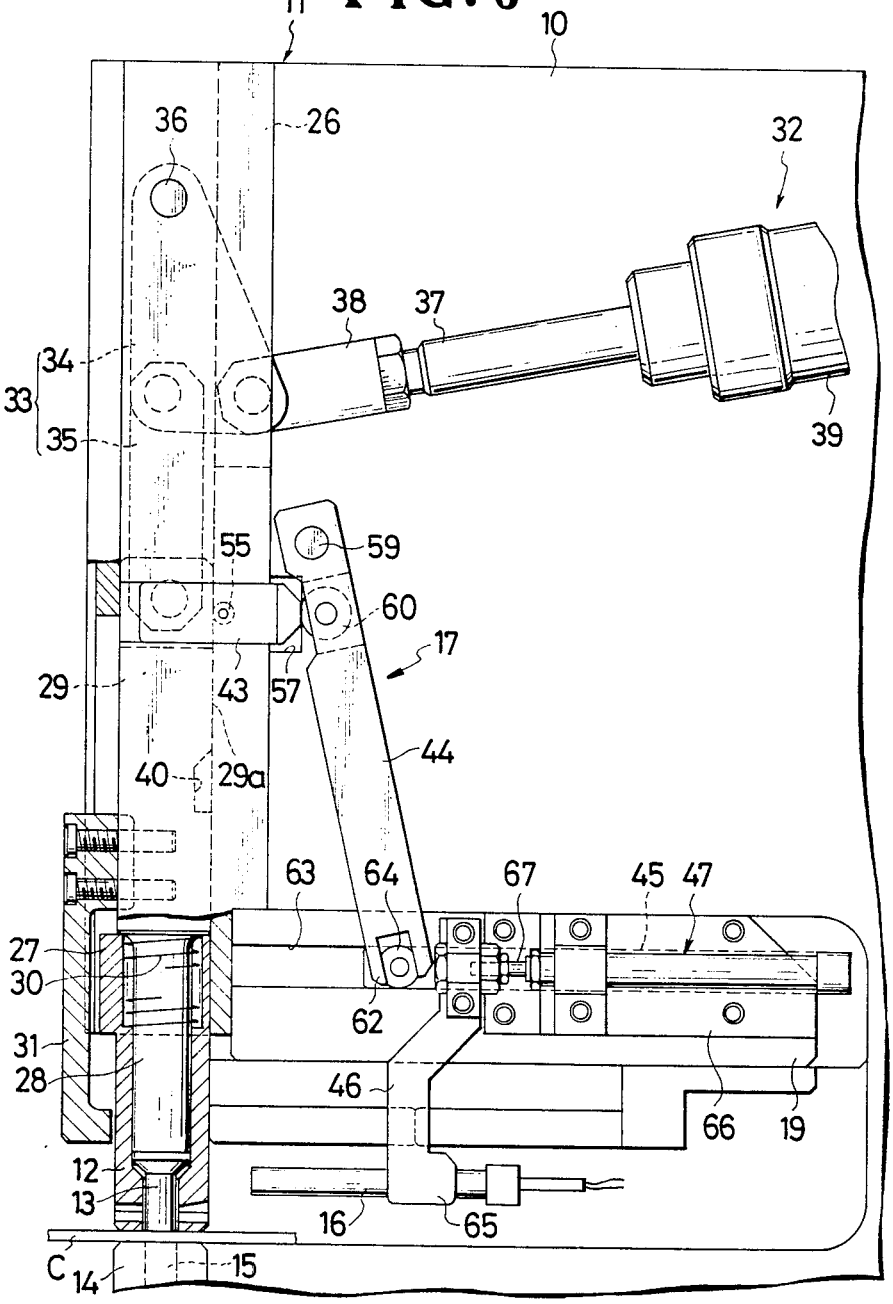
FIG. 8 is a view similar to FIG. 1, but showing the apparatus with parts in a different condition.

The upper holder 12 is slidably received in the vertical guide channel 23 in the ram guide 18 and has a lateral shoulder 27 projecting radially outwardly from an upper end portion of the holder 12, the lateral shoulder 27 being received in the vertical slot 25 in the cover plate 24. Though not designated, a pair of opposed clamp fingers is horizontally slidably mounted in a lower portion of the holder 12 for holding a fastener element A in front of the punch 13. The punch 13 is detachably connected to the lower end of a ram rod 28 slidably received in the tubular holder 12. The ram rod 28 is composed of an integral lower extension of a ram 29 and the ram 29 is slidably received in the vertical guide channel 23 in the guide block 11. The holder 12 is normally urged downwardly by a compression coil spring 30 disposed around the ram rod 28 and acting between the ram 29 and the holder 12. The downward movement of the holder 12 is limited by an elongate hook 31 secured to a lower portion of the ram 29 and engageable with the lateral shoulder 27 of the holder 12. The hook 31 is received in the vertical slot 25 in the cover plate 24 and vertically movable along the slot 25 in unison with the reciprocation of the ram 29. When the ram 29 is in its uppermost standby position, the ram 29 is vertically spaced from the holder 12 by a distance equal to the downward stroke of the punch 13. In this instance, the hook 31 engages the lateral shoulder 27 of the holder 12 to retain the holder 12 against displacement. When the punch 13 is lowered to clinch the two fastener elements A, B with a garment fabric C disposed therebetween, the holder 12 is moved downwardly together with the ram rod 28 and hence the punch 13 until the holder 12 engages the garment fabric C. A further downward movement of the ram 29 causes the hook 31 to move downwardly away from the lateral shoulder 27 of the holder 12 against the force of the spring 30 (FIG. 8). In the course of the upward stroke of the punch 13 and hence the ram 29, the hook 31 is brought into hooking engagement with the lateral shoulder 27 to thereby pull the holder 12 upwardly.

The ram 29 is vertically reciprocated by a fluid-pressure actuator such as an air cylinder 32 via a toggle joint 33 composed of a pair of first and second levers 34, 35. The first lever 34 is pivotably connected at its one end to the guide block 11 by a horizontal shaft 36 extending between the front and rear walls 20, 21, the other end of the first lever 34 being pivotably connected to a piston rod 37 of the air cylinder 32 via a short connecting rod 38. The second lever 35 is pivotably connected at opposite ends to the first lever 34 and the upper end of the ram 29. For connection, the levers 34, 35 extend into the guide channel 23 through the vertical groove 26 in the ram guide 18 of the guide block 11. The air cylinder 32 includes a cylinder tube 39 pivotably supported by the frame 10. In response to reciprocating movement of the piston rod 37, the first and second levers 34, 35 are pivotably moved relatively to each other between a contracted position in which the two levers 34, 35 are disposed substantially at a right angle to one another (FIG. 1), and an extended position in which the two levers 34, 35 are disposed substantially in a vertical straight line (FIG. 8). Thus, as the two levers 34, 35 are moved between the contracted and extended positions, the ram 29 and hence the punch 13 is moved vertically between the uppermost standby position and a lowermost clinching position.

Figure 3:
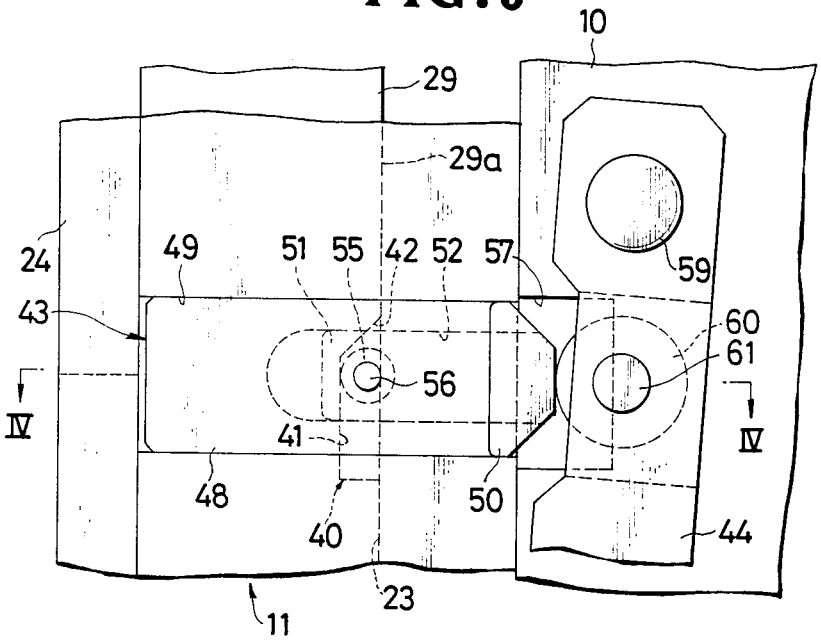
FIG. 3 is an enlarged front elevational view of a portion of the apparatus, showing an arrangement of the driver and related components.
Figure 6:
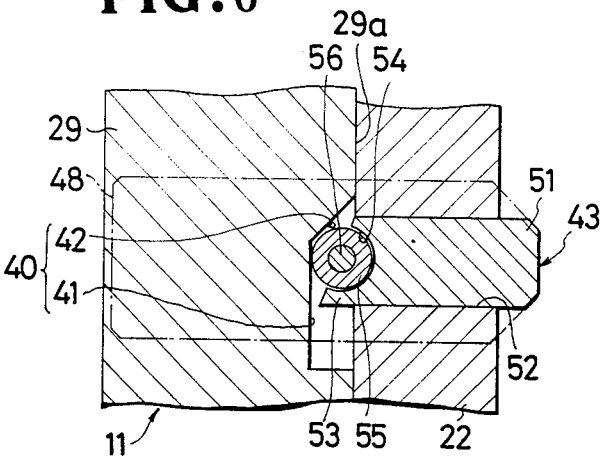
FIG. 6 is a cross-sectional view taken along line VI—VI of FIG. 4.

The ram 29 includes a longitudinal cam recess 40 defined in a vertical side surface 29*a* of the ram 29 facing the side wall 22 of the ram guide 18. The cam recess 40, as shown in FIGS. 3 and 6, includes a vertical lower cam surface 41 and a slanted upper cam surface 42 extending contiguously from an upper end of the vertical cam surface 41. The cam recess 40 controls the motion of the position-indicator drive mechanism 17 as described later on.

The drive mechanism 17 generally comprises a driver 43, a pivot lever 44, a slide bar 45, support lever 46 and a biasing device 47, all the components 43–47 being operatively connected together.

Figure 2:
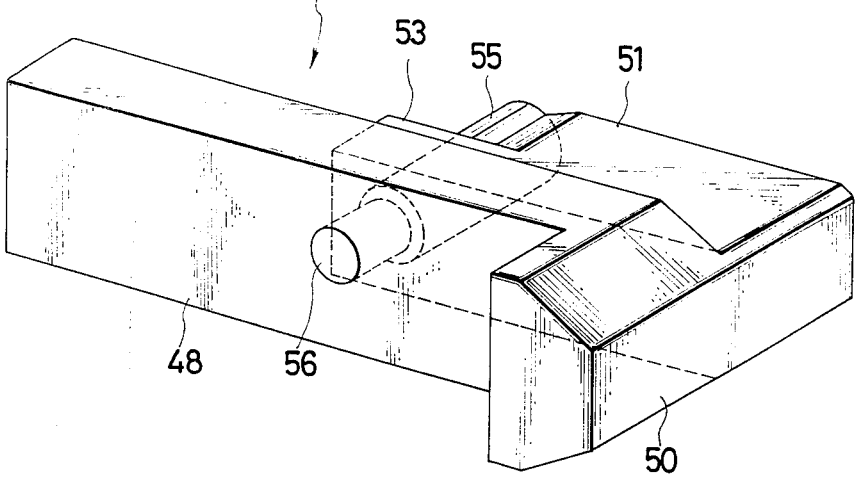
FIG. 2 is an enlarged perspective view of a driver of the drive mechanism shown in FIG. 1.
Figure 4:
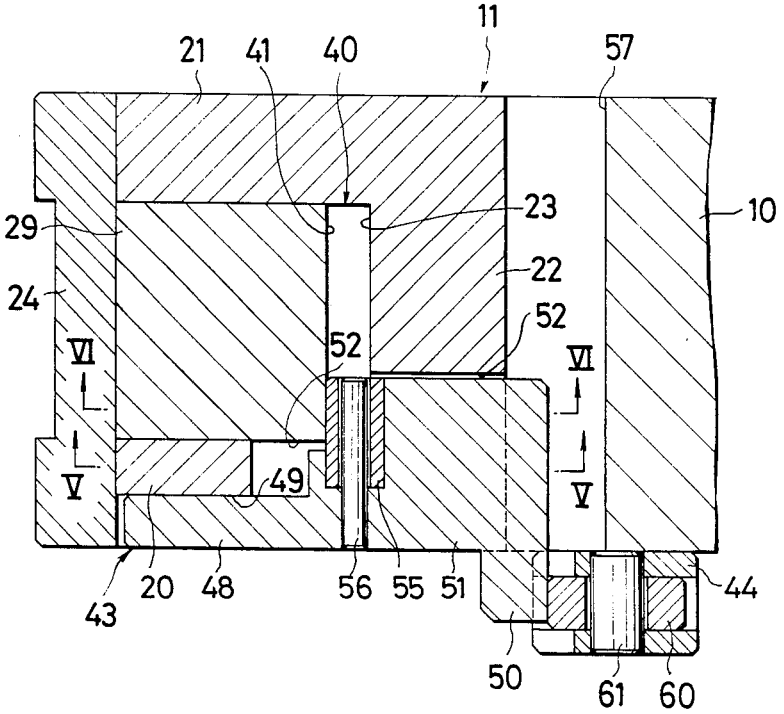
FIG. 4 is a cross-sectional view taken along line IV—IV of FIG. 3.
Figure 5:
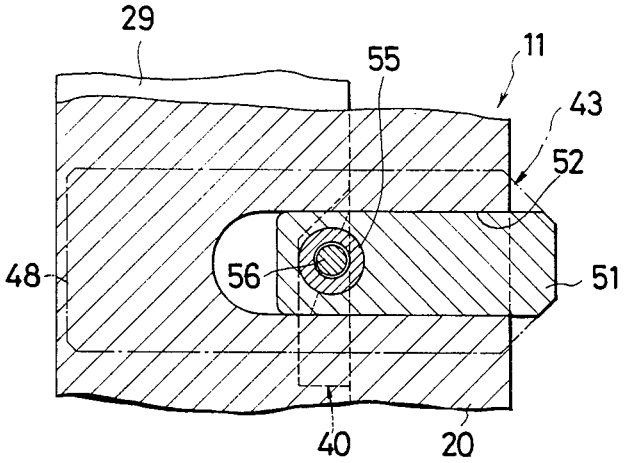
FIG. 5 is a cross-sectional view taken along line V—V of FIG. 4.

The driver 43, as shown in FIGS. 2 and 4, has a generally T-shape and is horizontally slidably mounted in a recessed corner of the ram guide 18 defined jointly by the front and side walls 20, 22 of the ram guide 18. The T-shaped driver 43 includes an elongate rectangular body 48 slidably received in a horizontal groove 49 in the front wall 20, a head 50 projecting perpendicularly from one end of the body 48 in a direction away from the rear wall 21 with engagement with the pivot lever 44 to actuate the same, and an enlarged lateral wing 51 projecting from the body 48 away from the head 50. The wing 51 is thinner than the body 48 and disposed at the center of the thicknes of the body 48. The lateral wing 51 extends longitudinally of the body 48 from an intermediate portion to the end of the body 48 where the head 48 is disposed. The wing 51 is slidably received in a horizontal slot 52 defined in the front and side walls 20, 22 and has an inner end portion 53 partly projectable into the cam recess 40 in the ram 29. The inner end portion 53 has an arcuate recess 54 (FIG. 6) facing toward the ram 29 for guidingly receiving therein a roller follower 55. The roller follower 55 is made of antifriction, abrasive resistant material such as hardened steel and is rotatably mounted on a cylindrical pin 56 secured to the body 48. The roller follower 55 is normally received in the cam recess 40 and held in rolling engagement with the vertical cam surface 41. With this construction, the driver 43 is horizontally reciprocable toward and away from the cover plate 24 in response to the vertical reciprocation of the ram 29. The frame 10 has a horizontal slot 57 facing the side wall 23 of the ram guide 18 in registry with the lateral wing 51 of the driver 43 for receiving therein the wing 51 as the driver 43 is horizontally reciprocated. In order to prevent lateral displacement of the driver 43 off the ram guide 19, a cover strip 58 (FIG. 1) is secured to the front wall 20.

The pivot lever 44 is pivotably connected at one end thereof to a horizontal shaft 59 secured to the frame 10 and includes a driven roller 60 rotatably mounted on a cylindrical pin 61 secured to the pivot lever 44. The driven roller 60 is made of antifriction, abrasive resistant material such as hardened steel and is held in rolling engagement with the head 50 of the driver 43. The pivot lever 44 has a bifurcated lower end 62 pivotably connected with the slide bar 45.

The slide bar 45 is slidably received in a horizontal guide groove 63 defined in the horizontal base 19 of the guide block 11, the guide groove 63 extending throughout the length of the base 19. The slide bar 45 carries on its forward end a pivotal element 64 fitted in the bifurcated lower end 62 of the pivot lever 44 so that the slide bar 45 is movable toward and away from the path of movement of the punch 13 in response to angular reciprocation of the pivot lever 44.

Figure 7:
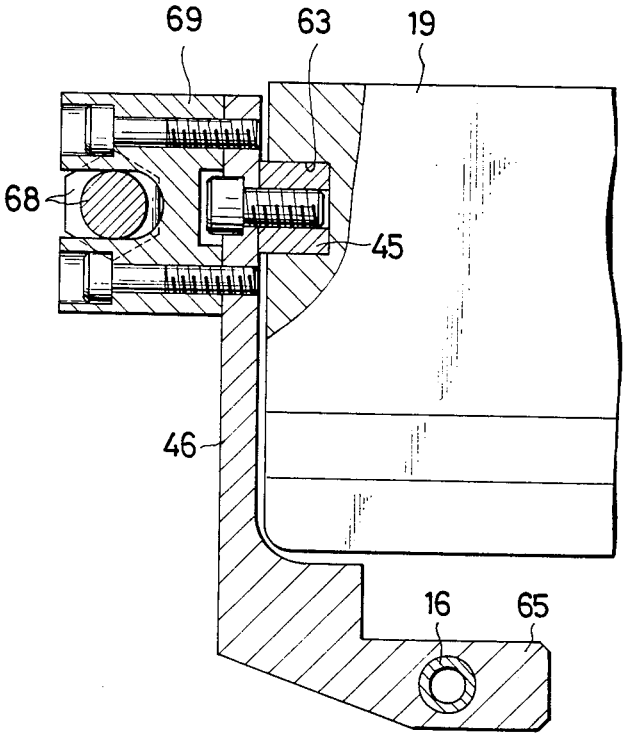
FIG. 7 is an enlarged cross-sectional view taken along line VII—VII of FIG. 1.

The support lever 46 is generally L-shaped, as shown in FIG. 7, and has an upper end secured to the slide bar 45. The L-shaped support lever 46 includes a horizontal mount 65 underlying the base 19 and supporting thereon the optical position indicator 16. The position on the slide bar 45 where the support lever 46 is to be attached is set such that when the slide bar 45 is fully advanced, the non-illustrated light projector of the optical position indicator 16 is located in registry with the path of movement of the punch 13.

The biasing device 47 is composed of a shock absorber in the form a dashpot mounted on a support block 66 which is secured to the base 19 to cover a rearward part of the groove 63. The dashpot 47 includes a piston rod 67 secured by a bolt-and-nut fastener 68 to an attachment block 69 secured to an upper end portion of the support lever 46. The piston rod 67 is normally held in a fully extended position shown in FIG. 1 and is retracted when the pivot lever 44 is turned counterclockwise in FIG. 1 to retract the slide bar 45. Upon pivotal movement of the pivot lever 44 in the clockwise direction, the piston rod 67 automatically returns to its fully extended position to thereby locate the position indicator 16 in the advanced indicating position.

The fastener-assembling apparatus of the foregoing construction operates as follows: For purposes of illustration, operation of the apparatus begins from the condition shown in FIG. 1, in which the piston rod 37 of the air cylinder 32 is fully retracted to keep the punch 13 in its uppermost standby position, and the piston rod 67 of the dashpot 47 is fully extended to hold the optical position indicator 16 in its advanced indicating position. Therefore, the light beam projected from the optical position indicator 16 passes along the common vertical axis of the punch 13 and the die 15 and produces a light sopt on a garment fabric C when the garment fabric C is disposed between the upper and lower holders 12, 14 in which two fastener elements A, B are retained, respectively.

After a position on the garment fabric C where the two fastener elements A, B are to be attached has been set in registry with the light spot, the air cylinder 32 is actuated to extend its piston rod 37. As the piston rod 37 is advanced, the toggle joint 33 extends its levers 34, 35 to thereby lower the ram 29 and the punch 13. The downward movement of the ram 29 causes the roller follower 55 on the driver 43 to roll along the cam recess 40 in the ram 29 from the vertical cam surface 41 toward the slanted cam surface 42. In response to the rolling engagement of the roller follower 55 with the slanted cam surface 42, the driver 43 slides horizontally rightwardly in FIG. 1 to turn the pivot lever 44 counterclockwise about the shaft 59, whereupon the slide bar 45 is moved rearwardly along the groove 63 against the bias of the dashpot 47. Consequently, the optical position indicator 16, which is connected with the slide bar 45 through the support lever 46, is moved from the advanced indicating position of FIG. 1 to the retracted standby position of FIG. 8. As the ram 29 is further moved downwardly, the roller follower 55 rolls on and along a longitudinal portion of the vertical side surface **29*a* of the ram 29 extending upwardly from the cam recess 40, so that the position indicator 16 is kept immovable in its standby position. When the ram 29 is fully lowered, the two fastener elements A, B are clinched together by and between the punch 13 and die 15**, with the garment fabric C is firmly gripped between the fastener elements A, B.

Then the air cylinder 32 is actuated to retract its piston rod 37 whereupon the toggle joint 33 contracts its levers 34, 35 to move the ram 29 and the punch 13 upwardly. As the ram 29 is moved upwardly, the follower roller 55 is caused to roll into the cam recess 45 in the ram 29 under the bias of the dashpot 47. Stated more specifically, since the dashpot 47 continuously urges the slide bar 45 forwardly to turn the pivot lever 44 clockwise about the shaft 59, the driver 43 is slid leftwardly in FIG. 8 immediately when the follower roller 55 faces the cam recess 40. With this movement of the driver 43, the optical position indicator 16 returns to its advanced indicating position shown in FIG. 1. When the ram 29 is fully retracted, the roller follower 55 is held in engagement with the vertical surface 41 of the cam recess 40.

As described above, the drive mechanism 17 for the position indicator 16 is directly driven by the ram 29 with the result that the position indicator can be moved toward and away from the path of movement of the punch 13 without interference with any other movable component. Furthermore, the operation of the ram-driven drive mechanism 17 does not cause prolongation of the cycle time of the fastener assembling apparatus.

Obviously, many modifications and variations of the present invention are possible in the light of the above teachings. For example, the dashpot 47 may be replaced with any other suitable biasing means, such as a spring for urging the slide bar 45 or the pivot lever 44 in a direction to move the driver 43 leftwardly in FIG. 1, thereby keeping the roller follower 55 in rolling engagement with the ram 29. It is therefore to be understood that within the scope of the appended claims, the invention may be practiced otherwise than as specifically described.

What is claimed is:

1. An apparatus for assemblying a pair of fastener elements of a garment fastener with a garment fabric disposed between the two fastener elements, comprising:

(a) a frame supporting thereon a guide block;

(b) a ram vertically reciprocably supported on said guide block and having a punch connected thereto;

(c) an optical position indictor for indicating a position on the garment fabric where the two fastener elements are to be attached; and (d) a drive mechanism for reciprocating said position indicator between an indicating position located in registry with the path of movement of said punch and a standby position remote from the path of movement of said punch, said drive mechanism including (i) a driver slidably mounted on said guide block and horizontally reciprocable in response to vertical movement of said ram, (ii) a pivot lever pivotably supported by said frame and angularly reciprocable in response to horizontal movement of said driver, (iii) a slide bar slidably mounted on said guide block and supporting said optical position indicator, said slide bar being pivotably connected with said pivot lever to reciprocate said optical position indicator between said indicating position and said standby position in response to angular movement of said pivot lever, and (iv) biasing means for urging said slide bar in a direction to move said optical position indicator toward said indicating position.

2. An apparatus according to claim 1, said ram having a longitudinal cam recess, said driver including a roller follower normally received in said cam recess.

3. An apparatus according to claim 2, said cam recess being defined by a vertical cam surface and a slanted cam surface extending contiguously upwardly from said vertical cam surface, said roller follower being normally held in rolling engagement with said vertical cam surface.

4. An apparatus according to claim 2, said ram including a vertical side surface extending upwardly from said cam recess and engageable with said roller follower.

5. An apparatus according to claim 1, said driver having a head, said pivot lever including a driven roller held in engagement with said head.

6. An apparatus according to claim 1, said biasing means comprising a dashpot mounted on said guide block and having a piston rod connected with said slide bar.

* * * * *